US011026516B2

(12) United States Patent
Rawls-Meehan et al.

(10) Patent No.: US 11,026,516 B2
(45) Date of Patent: Jun. 8, 2021

(54) ADJUSTABLE BED APPARATUS AND METHODS INCORPORATING A RAIL SYSTEM

(71) Applicant: ASCION, LLC, Bloomfield Hills, MI (US)

(72) Inventors: Martin B. Rawls-Meehan, Birmingham, MI (US); Qianyu Liang, Auburn Hills, MI (US); Man-Chi Liu, Bloomfield Hills, MI (US); Kyle Allen Nagelkirk, Waterford Township, MI (US); Leandro Vera, West Bloomfield, MI (US)

(73) Assignee: ASCION, LLC, Bloomfield Hills, MI (US)

( * ) Notice: Subject to any disclaimer, the term of this patent is extended or adjusted under 35 U.S.C. 154(b) by 616 days.

(21) Appl. No.: 15/411,496

(22) Filed: Jan. 20, 2017

(65) Prior Publication Data

US 2017/0208956 A1 Jul. 27, 2017

Related U.S. Application Data

(60) Provisional application No. 62/286,049, filed on Jan. 22, 2016.

(51) Int. Cl.
*A47C 20/08* (2006.01)
*A47C 20/04* (2006.01)

(52) U.S. Cl.
CPC ..... *A47C 20/041* (2013.01); *A47C 20/08* (2013.01)

(58) Field of Classification Search
CPC ..... A47C 20/08; A47C 20/00; A47C 20/04
USPC ..... 5/613–618
See application file for complete search history.

(56) References Cited

U.S. PATENT DOCUMENTS

| | | | |
|---|---|---|---|
| 7,321,811 | B1 | 1/2008 | Rawls-Meehan |
| 7,465,280 | B2 | 12/2008 | Rawls-Meehan |
| 7,805,785 | B2 | 10/2010 | Rawls-Meehan |
| 7,930,783 | B2 | 4/2011 | Rawls-Meehan |
| 7,933,669 | B2 | 4/2011 | Rawls-Meehan |
| 7,979,169 | B2 | 7/2011 | Rawls-Meehan |
| 8,019,486 | B2 | 9/2011 | Rawls-Meehan |
| 8,032,263 | B2 | 10/2011 | Rawls-Meehan |
| 8,032,960 | B2 | 10/2011 | Rawls-Meehan |

(Continued)

*Primary Examiner* — Fredrick C Conley
(74) *Attorney, Agent, or Firm* — Marshall, Gerstein & Borun LLP

(57) ABSTRACT

The disclosure generally relates to an adjustable bed apparatus, in particular an adjustable bed foundation. The adjustable foundation can include a rail system such as a detachable rail system, which can be configured to conceal mechanical and support substructure beneath the mattress support surface of the adjustable bed. In some embodiments, the rail system includes a mounting element and a corresponding rail or board mounted to the adjustable foundation, such as to the subframe of the adjustable foundation. The adjustable foundation can include independently adjustable lumbar and neck support structures on an adjustable back/head section of the adjustable bed foundation. In some embodiments, the lumbar and neck support structures include inflatable air bladder structures. In other embodiments, the lumbar and neck support structures include mechanically actuatable subsections of the adjustable back/head section of the adjustable bed foundation

18 Claims, 12 Drawing Sheets

(56) References Cited

U.S. PATENT DOCUMENTS

| | | | | |
|---|---|---|---|---|
| 8,046,114 | B2 | 10/2011 | Rawls-Meehan | |
| 8,046,115 | B2 | 10/2011 | Rawls-Meehan | |
| 8,046,116 | B2 | 10/2011 | Rawls-Meehan | |
| 8,046,117 | B2 | 10/2011 | Rawls-Meehan | |
| 8,050,805 | B2 | 11/2011 | Rawls-Meehan | |
| 8,069,512 | B2 | 12/2011 | Rawls-Meehan | |
| 8,078,336 | B2 | 12/2011 | Rawls-Meehan | |
| 8,078,337 | B2 | 12/2011 | Rawls-Meehan | |
| 8,150,562 | B2 | 4/2012 | Rawls-Meehan | |
| 8,375,488 | B2 | 2/2013 | Rawls-Meehan | |
| 8,565,934 | B2 | 10/2013 | Rawls-Meehan | |
| 8,682,457 | B2 | 3/2014 | Rawls-Meehan | |
| 2005/0011005 | A1* | 1/2005 | Borda | A47C 19/04 5/412 |
| 2007/0157388 | A1* | 7/2007 | Mossbeck | A47C 20/041 5/618 |
| 2012/0057685 | A1 | 3/2012 | Rawls-Meehan | |
| 2014/0325761 | A1 | 11/2014 | Rawls-Meehan | |

* cited by examiner

ADJUSTABLE BED APPARATUS AND METHODS INCORPORATING A RAIL SYSTEM

CROSS REFERENCE TO RELATED APPLICATION

Priority is claimed to U.S. Provisional Application No. 62/286,049 (filed Jan. 22, 2016), which is incorporated herein by reference in its entirety.

STATEMENT OF GOVERNMENT INTEREST

None.

BACKGROUND OF THE DISCLOSURE

Field of the Disclosure

The disclosure generally relates to an adjustable bed apparatus, in particular an adjustable bed foundation. The adjustable foundation can include a rail system, for example a detachable rail system. Alternatively or additionally the adjustable foundation can include independently adjustable lumbar and neck support structures on an adjustable back/head section of the adjustable bed foundation.

SUMMARY

In one aspect, the disclosure relates to an adjustable bed comprising: (a) a stationary bed frame comprising (i) a stationary subframe, and optionally (ii) a support member mounted to the subframe for supporting a mattress support surface; (b) a mattress support surface supported by the stationary bed frame and comprising (i) a first deck support section, and (ii) a second deck support section pivotally attached to the first deck support section; (c) a mounting element having (i) a first end (fixedly or detachably) mounted to at least one of the subframe and the support member (when present) and (ii) a second end extending outwardly from the stationary bed frame and positioned at a location at or below the subframe; and (d) a rail (fixedly or detachably) mounted to the second end of the mounting element, the rail extending along an external side of the subframe.

In another aspect, the disclosure relates to an adjustable bed kit comprising: (a) a stationary bed frame comprising (i) a stationary subframe, and optionally (ii) a support member mounted to the subframe for supporting a mattress support surface; (b) a mattress support surface supported by the stationary bed frame and comprising (i) a first deck support section, and (ii) a second deck support section pivotally attached to the first deck support section; (c) a mounting element having (i) a first end adapted to be mounted to at least one of the stationary subframe and the support member (when present) and (ii) a second end that extends outwardly from the stationary bed frame and is positioned at a location at or below the subframe when the mounting element is mounted to the at least one of the stationary subframe and the support member; and (d) a rail adapted to be mounted to the second end of the mounting element, wherein, when mounted to the mounting element, the rail extends along an external side of the subframe.

Various embodiments and refinements of the adjustable bed and corresponding kit and component thereof are possible.

In a refinement, the rail vertically extends below the subframe.

In another refinement, the rail vertically extends above the subframe.

In another refinement, such as when the rail vertically extends above the subframe, the mattress support surface further comprises (i) a first deck support spacer extending along an external side of the first deck support section and vertically extending below the first deck support section, and (ii) a second deck support spacer extending along an external side of the second deck support section and vertically extending below the second deck support section. In a further refinement, when the mattress support surface is in a flat configuration, the first deck support spacer, the second deck support spacer, and the rail form a substantially continuous side surface to the adjustable bed. In another further refinement, the first deck support spacer, the second deck support spacer, and the rail are formed from the same or different materials. In another further refinement, the first deck support spacer and the second deck support spacer are formed from a polymeric foam, for example where the rail is formed from a material selected from the group consisting of wood, metal, and combinations thereof.

In another refinement, the first end of the mounting element is detachably mounted to the at least one of the stationary subframe and the support member.

In another refinement, the second end of the mounting element is detachably mounted to the rail.

In another refinement, the mounting element is mounted to the subframe. In a further refinement, the mounting element is mounted to a longitudinal subframe member extending between head and foot ends of the adjustable bed (e.g., stationary bed frame thereof) as the subframe, for example where the mattress support surface is longitudinally slidably mounted to the longitudinal subframe member. In another further refinement, the second end of the mounting element extends outwardly from the stationary bed frame substantially parallel to the subframe.

In another refinement, the stationary bed frame comprises the support member, and the mounting element is mounted to the support member. In a further refinement, the subframe does not include longitudinal subframe member extending between head and foot ends of the adjustable bed. In another further refinement, the first end of the mounting element extends downwardly from the support member and the second end of the mounting element extends outwardly from the stationary bed frame substantially parallel to the subframe.

In another refinement, the mounting element comprises a receiving sleeve.

In another refinement, the bed further comprises at least 4 rails and at least 4 corresponding mounting elements, wherein: there is at least one corresponding mounting element for each rail; and the at least 4 rails collectively form a continuous rail border around the external perimeter of the adjustable bed.

In another refinement, the rail is formed from wood.

In another refinement, the rail is formed from metal.

In another refinement, the mattress support surface further comprises (iii) a third deck support section pivotally attached to the second deck support section, and (iv) optionally a fourth deck support section pivotally attached to the third deck support section.

In another refinement, the bed further comprises a mattress positioned above the mattress support surface. The mattress can be selected from the group consisting of a spring mattress, a coil mattress, a memory foam mattress, and an air mattress.

In another aspect, the disclosure relates to an adjustable bed comprising: (a) a mattress support surface comprising (i) a first deck support section corresponding to a back and head portion of the mattress support surface, and (ii) a second deck support section pivotally attached to the first deck support section; (b) an inflatable lumbar support laterally extending across the first deck support section and disposed on an upper surface of the first deck support section; and (c) an inflatable neck support laterally extending across the first deck support section and disposed on an upper surface of the first deck support section.

Various embodiments and refinements of the adjustable bed are possible.

In a refinement, the inflatable lumbar support is positioned in a bottom region of the first deck support section.

In another refinement, the inflatable neck support is positioned in a top region of the first deck support section.

In another refinement, the inflatable lumbar support extends at least 60% of the mattress support surface lateral width.

In another refinement, the inflatable neck support extends at least 60% of the mattress support surface lateral width.

In another refinement, the inflatable lumbar support is a single inflatable bladder extending across the first deck support section.

In another refinement, the inflatable lumbar support comprises a plurality of inflatable bladders extending across the first deck support section.

In another refinement, the inflatable neck support is a single inflatable bladder extending across the first deck support section.

In another refinement, the inflatable neck support comprises a plurality of inflatable bladders extending across the first deck support section.

In another refinement, the adjustable bed further comprises a means for supplying pressure to the inflatable lumbar support and the inflatable neck support.

In another refinement, the adjustable bed further comprises a flexible lumbar pressure distribution member mounted to the first deck support section and at least partially covering or enclosing the inflatable lumbar support.

In another refinement, the adjustable bed further comprises a flexible neck pressure distribution member mounted to the first deck support section and at least partially covering or enclosing the inflatable neck support.

In another aspect, the disclosure relates to an adjustable bed comprising: (a) a stationary bed frame; and (b) a mattress support surface supported by the stationary bed frame and comprising (i) a first deck support section corresponding to a back and head portion of the mattress support surface, and (ii) a second deck support section pivotally attached to the first deck support section; the first deck support section comprising: a longitudinally extending support frame pivotally attached to the second deck support section; a back support deck section fixedly mounted to an upper surface of a middle section of the support frame; a first actuator having (A) a first end mounted to one or more of the second deck support section and the stationary bed frame, and (B) a second end mounted to the support frame, wherein the first actuator is adapted to move the support frame between articulated and substantially flat positions relative to the stationary bed frame; a lumbar support deck section pivotally mounted to the second deck support section and positioned above an upper surface of a bottom section of the support frame; a second actuator having (A) a first end mounted to the support frame, and (B) a second end mounted to the lumbar support deck section, wherein the second actuator is adapted to move the lumbar support deck section between articulated and substantially flat positions relative to the support frame; a neck support deck section pivotally mounted to the support frame and positioned above an upper surface of a top section of the support frame; and a third actuator having (A) a first end mounted to the support frame, and (B) a second end mounted to the neck support deck section, wherein the third actuator is adapted to move the neck support deck section between articulated and substantially flat positions relative to the support frame.

In some embodiments, the first end of the first actuator has a fixed pivotal attachment to the one or more of the second deck support section and the stationary bed frame, and the second end of the first actuator has a fixed pivotal attachment to the support frame. In some embodiments, the first end of the second actuator has a fixed pivotal attachment to the support frame, and the second end of the second actuator has a floating pivotal attachment to the lumbar support deck section. In some embodiments, the first end of the third actuator has a fixed pivotal attachment to the support frame, and the second end of the third actuator has a floating pivotal attachment to the neck support deck section.

Various embodiments and refinements of the adjustable bed are possible.

In a refinement, the mattress support surface further comprises (iii) a third deck support section pivotally attached to the second deck support section, and (iv) optionally a fourth deck support section pivotally attached to the third deck support section.

In another refinement, the bed further comprises a mattress positioned above the mattress support surface. The mattress can be selected from the group consisting of a spring mattress, a coil mattress, a memory foam mattress, and an air mattress.

In another refinement, the adjustable bed comprises first and second mattress support surfaces arrange in a side-by-side configuration, and first and second inflatable lumbar supports and inflatable neck supports positioned on the respective first deck support sections.

Additional features of the disclosure may become apparent to those skilled in the art from a review of the following detailed description, taken in conjunction with the drawings, examples, and appended claims.

BRIEF DESCRIPTION OF THE DRAWINGS

For a more complete understanding of the disclosure, reference should be made to the following detailed description and accompanying drawings wherein.

While the disclosed apparatus and methods and are susceptible of embodiments in various forms, specific embodiments of the disclosure are illustrated (and will hereafter be described) with the understanding that the disclosure is intended to be illustrative, and is not intended to limit the claims to the specific embodiments described and illustrated herein.

DETAILED DESCRIPTION

The disclosure generally relates to an adjustable bed apparatus, in particular an adjustable bed foundation. The adjustable foundation includes independently adjustable lumbar and neck support structures on an adjustable back/head section of the adjustable bed foundation. In some embodiments, the lumbar and neck support structures include inflatable air bladder structures. In other embodiments, the lumbar and neck support structures include mechanically actuatable subsections of the adjustable back/head section of the adjustable bed foundation.

Figure 1:
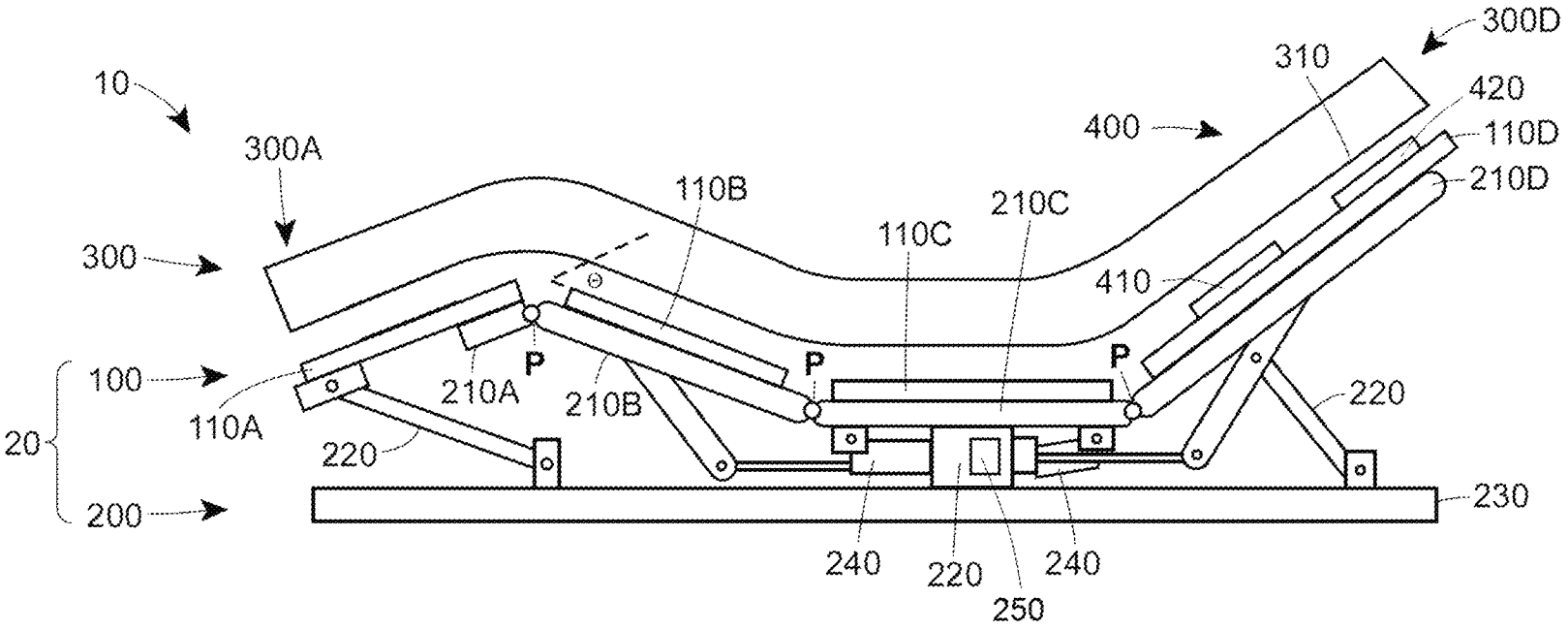
FIG. 1 is a side view of an adjustable bed according to the disclosure.
Figure 2:
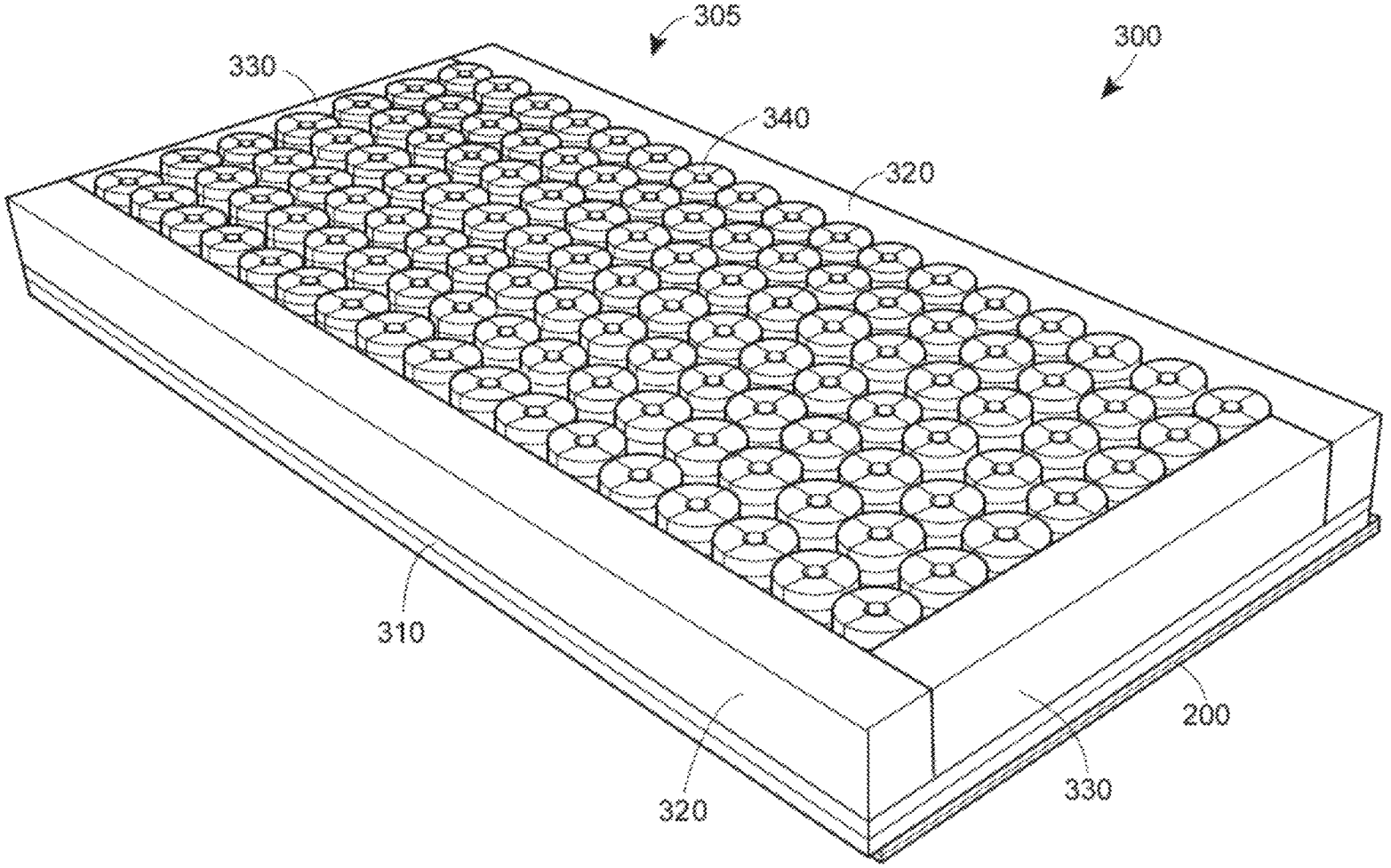
FIG. 2 is a perspective view of a mattress for use with the adjustable bed of FIG. 1.
Figure 3:
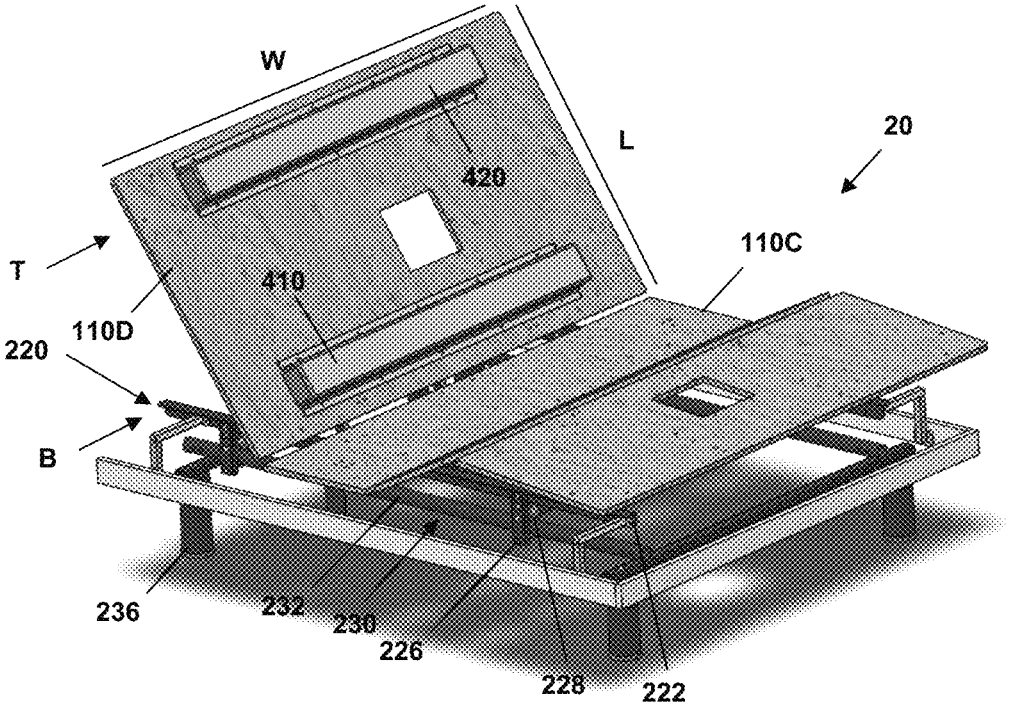
FIG. 3 is a front perspective view of an adjustable bed according to the disclosure including inflatable air bladder lumbar and neck support structures.
Figure 4:
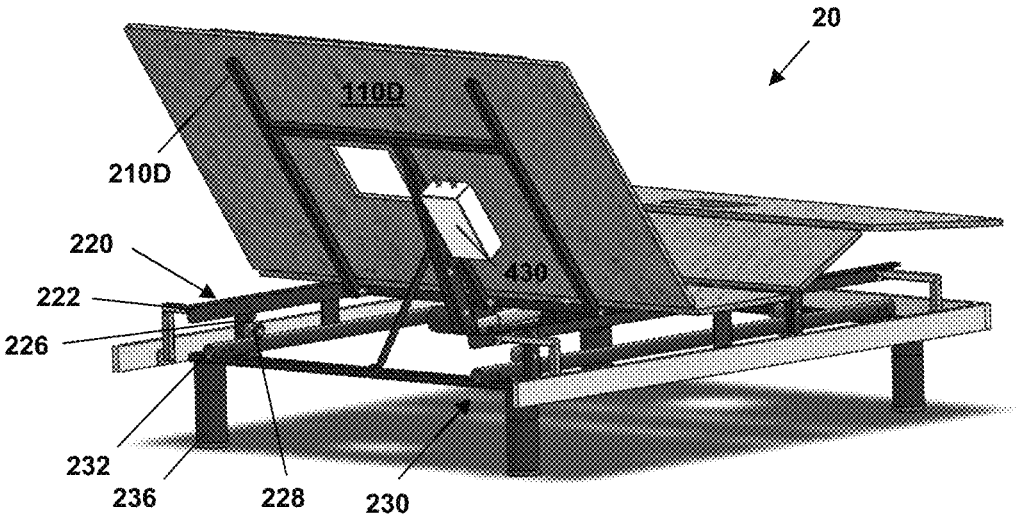
FIG. 4 is a rear perspective view of an adjustable bed according to the disclosure including inflatable air bladder lumbar and neck support structures.
Figure 12:
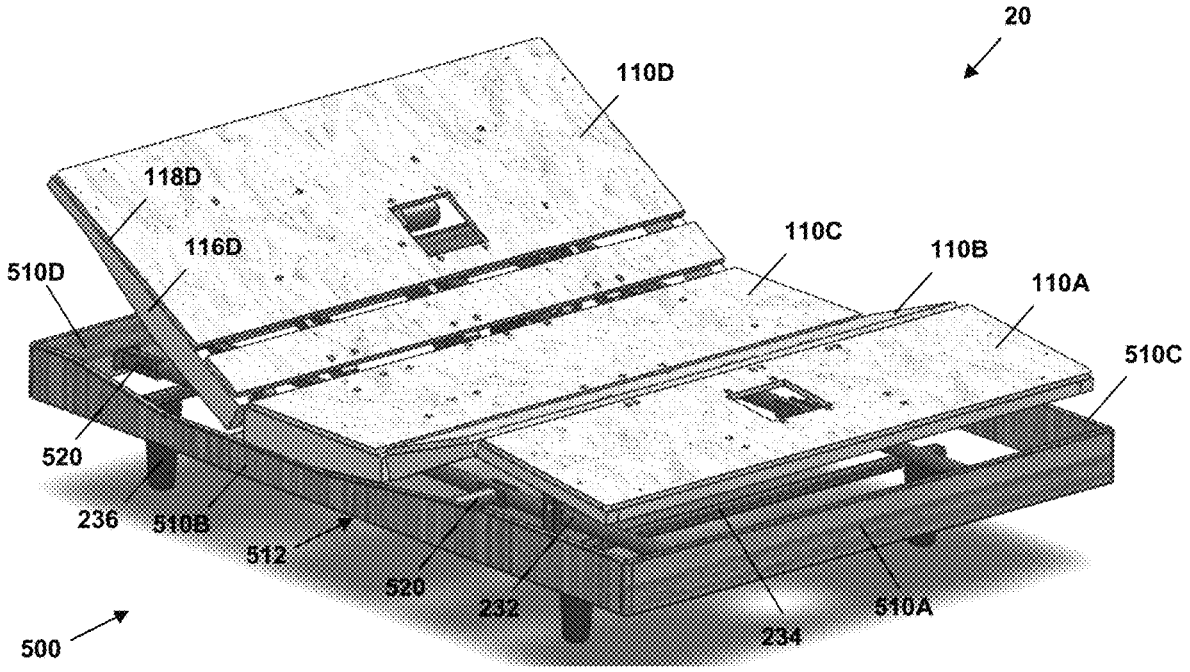
FIG. 12 is a front perspective view of an adjustable bed according to the disclosure including a rail system according to a first embodiment of the disclosure.
Figure 12A:
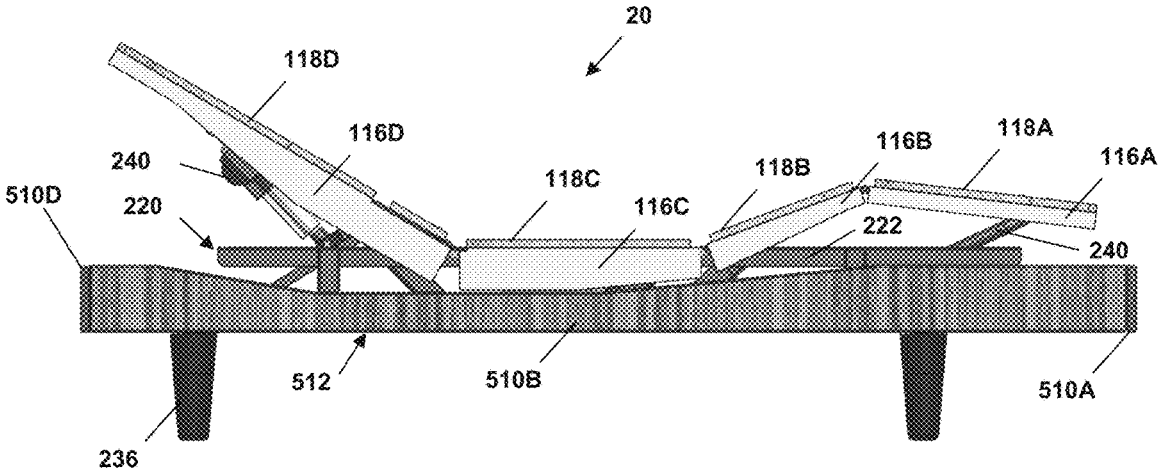
FIG. 12A is a side view of an adjustable bed according to the disclosure in an articulated position and including a rail system according to the first embodiment.
Figure 12B:
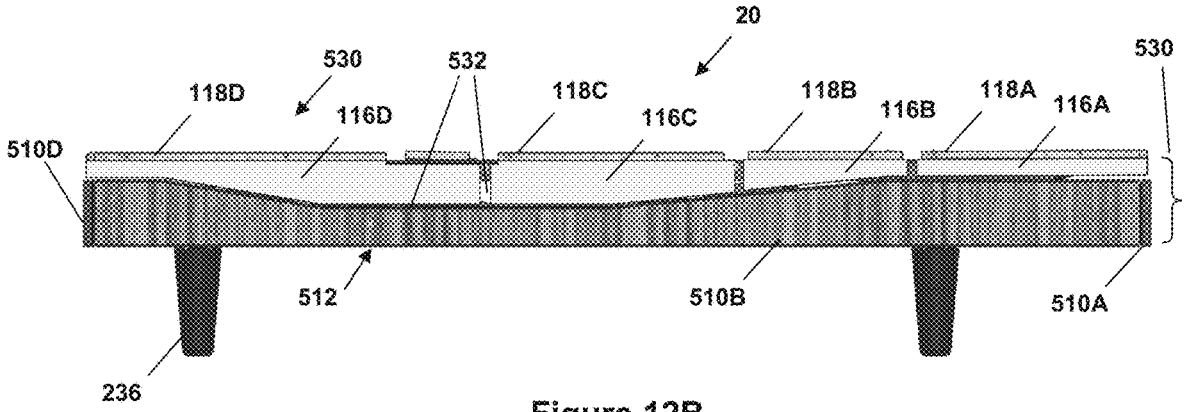
FIG. 12B is a side view of an adjustable bed according to the disclosure in a flat position and including a rail system according to the first embodiment.
Figure 13:
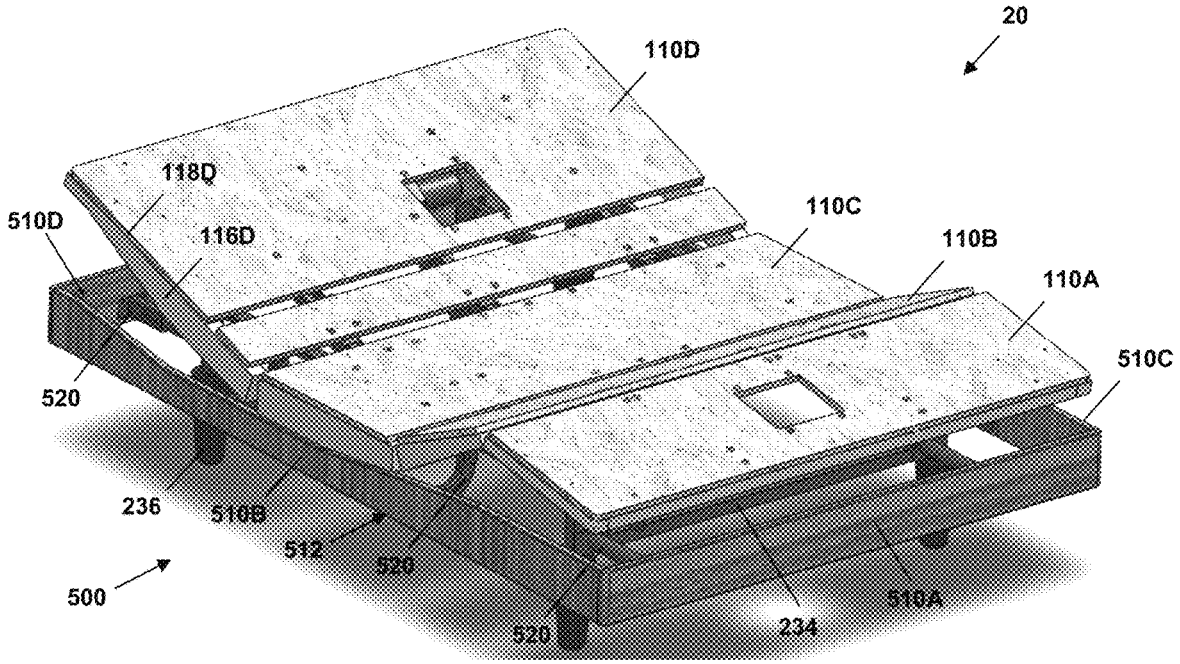
FIG. 13 is a front perspective view of an adjustable bed according to the disclosure including a rail system according to a second embodiment of the disclosure.
Figure 14:
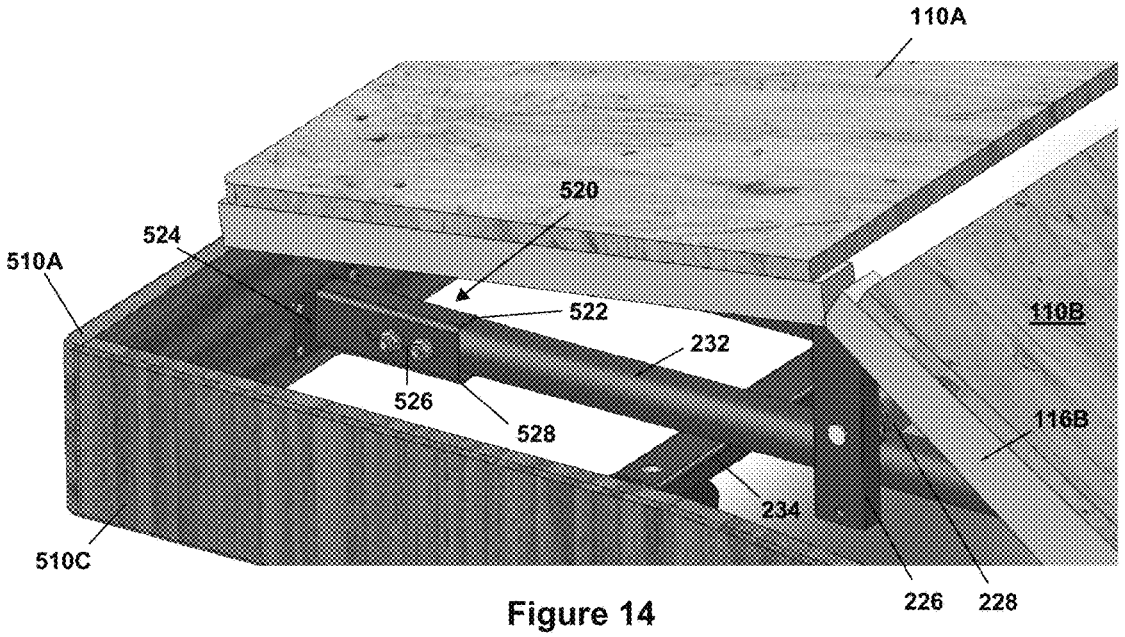
FIG. 14 is a close front perspective view of an adjustable bed according to the disclosure including a rail system according to the first embodiment.
Figure 15:
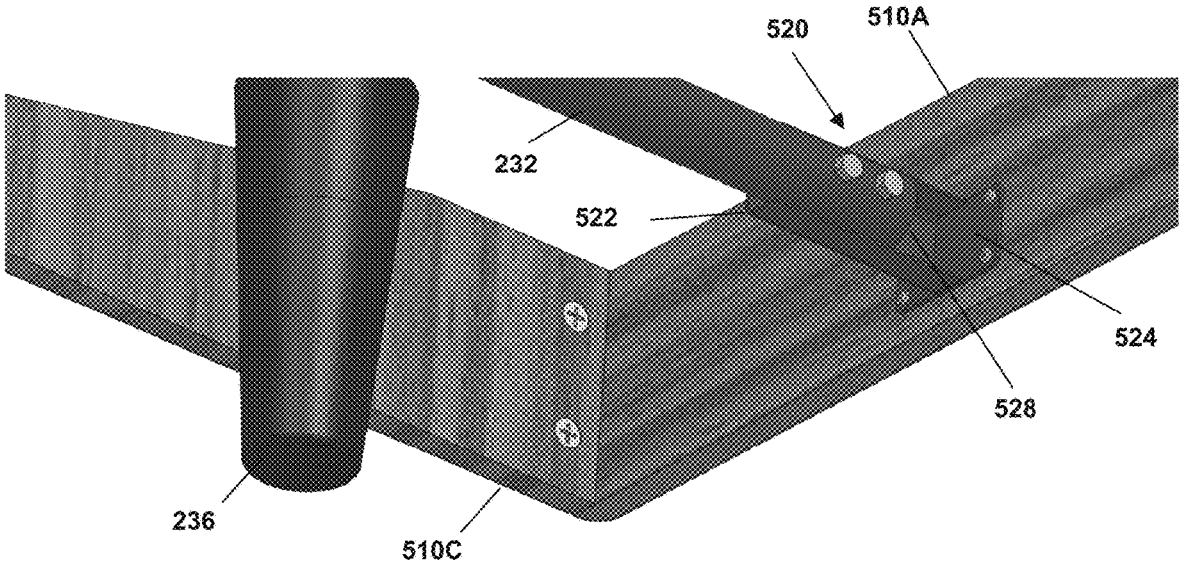
FIG. 15 is a bottom end perspective view of an adjustable bed according to the disclosure including a rail system according to the first embodiment.

FIG. 1 is a side view of an adjustable bed 10 according to the disclosure. The illustrated adjustable bed 10 includes an adjustable foundation 20 (e.g., adjustable bed foundation), a mattress 300 sitting atop the adjustable foundation 20, and a lumbar and neck support system 400 (e.g., lumbar support structure 410 and neck support structure 420 positioned at one or more locations on a back/head portion of the foundation 20 and in direct or indirect contact with the mattress 300). In other embodiments, the adjustable bed 10 can include a rail system 500 as illustrated in FIG. 12 and FIG. 13. In some embodiments the adjustable bed 10 can include both the lumbar and neck support system 400 and the rail system 500, and in some embodiments the bed 10 can include only one of the two systems 400, 500. The adjustable foundation 20 can include a mattress support (or deck) 100 mounted to an adjustable frame 200. FIG. 2 is a top perspective illustration of a mattress 300 according to the disclosure.

The mattress support 100 includes a deck support 110 platform, for example including a plurality of deck support sections 110A-110D as illustrated. A deck support platform 110 formed from a plurality of deck support sections 110A-110D, each having a corresponding upper surface 112A-112D (i.e., the surface which supports the mattress 300) is suitable for the adjustable foundation 20. In the illustrated embodiment, section 110A corresponds to the foot portion of the bed, section 110B corresponds to the leg portion of the bed, section 110C corresponds to the bottom portion of the bed, and section 110D corresponds to the head and neck portion of the bed 10 (i.e., where the sections correspond to the body portion of a user laying on the bed 10/mattress 300 in a normal use orientation). Each section 110A-110D includes longitudinally opposed ends 110$A_1$ and 110$A_2$, 110$B_1$ and 110$B_2$, 1100$_1$ and 1100$_2$, 110$D_1$ and 110$D_2$, respectively, where the longitudinal direction Y is generally defined as being perpendicular to the pivot axis P (described below) and/or along the mattress support 100 length or mattress 300 length. Each deck support section 110A-110D can be pivotally attached to one or more adjacent sections (e.g., directly or indirectly via underlying frame 200 structure as described below), thus allowing each section 110A-110D to rotate independently around the lateral pivot axis P (e.g., an axis generally in the lateral direction X and perpendicular to the longitudinal direction Y). The mattress support 100 generally includes at least two deck support sections, for example including a fourth (foot) support section 110A, a third (leg) support section 110B pivotally attached to the fourth section 110A, a second (bottom) support section 110C pivotally attached to the third section 110B, and a first (back/neck/head) support section 110D pivotally attached to the second section 110C as shown in FIG. 1. In other embodiments (not shown), the mattress support 100 can have fewer or more support sections (e.g., a third (foot) support section, a second (leg and bottom) support section pivotally attached thereto, and a first (back/head/neck) support section pivotally attached thereto). In some embodiments the support sections 110A-110D can be formed from a rigid support material such as wood or metal. In other embodiments the support sections 110A-110D can be formed from a flexible fabric or padding material (e.g., alone or in combination with a rigid support material, such as a cover or padding for an underlying rigid support material).

The adjustable frame 200 generally provides the mechanical, electrical, and electronic support and articulation components for the adjustable foundation 20 and bed 10. As illustrated, the adjustable frame 200 includes a frame support 210, for example including a plurality of frame support sections 210A-210D as illustrated and corresponding to the deck support sections 110A-110D. Each deck support section 110A-110D can be fixedly or removably mounted (e.g., via bolts, screws, or other fastener or adhesive components) to its underlying frame support section 210A-210D such that when one or more frame support sections 210A-210D are articulated, the deck support sections 110A-110D are correspondingly articulated. As illustrated, each frame support section 210A-210D can be pivotally attached at a pivot axis P to one or more adjacent sections (e.g., directly as illustrated and providing an indirect pivotal attachment for corresponding deck support sections), thus allowing each section 210A-210D to rotate independently around the lateral pivot axis P. The adjustable frame 200 generally includes at least two frame support sections, for example including a first (foot) support section 210A, a second (leg) support section 210B pivotally attached to the first section 210A, a third (bottom) support section 210C pivotally attached to the second section 210B, and a fourth (head/neck) support section 210D pivotally attached to the third section 210C as shown in FIG. 1. In other embodiments (not shown), the adjustable frame 200 can have fewer or more frame support sections (e.g., a first (foot) support section, a second (leg and bottom) support section pivotally attached thereto, and a third (head/neck) support section pivotally attached thereto).

Figure 16:
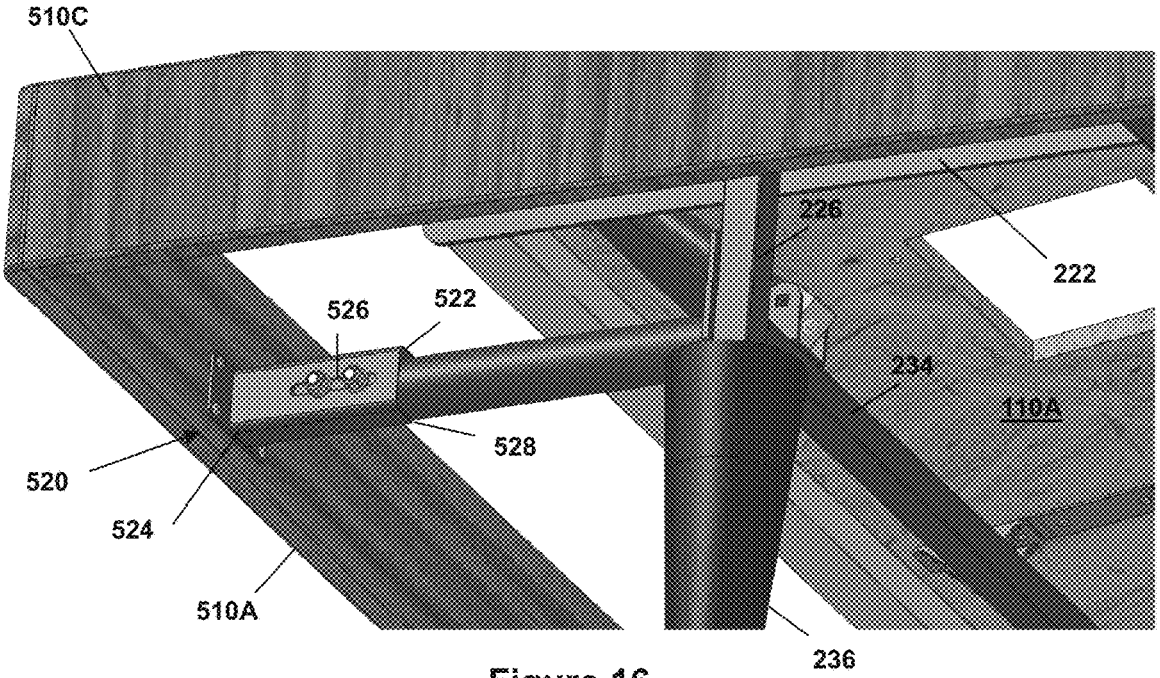
FIG. 16 is a bottom end perspective view of an adjustable bed according to the disclosure including a rail system according to the second embodiment.
Figure 17:
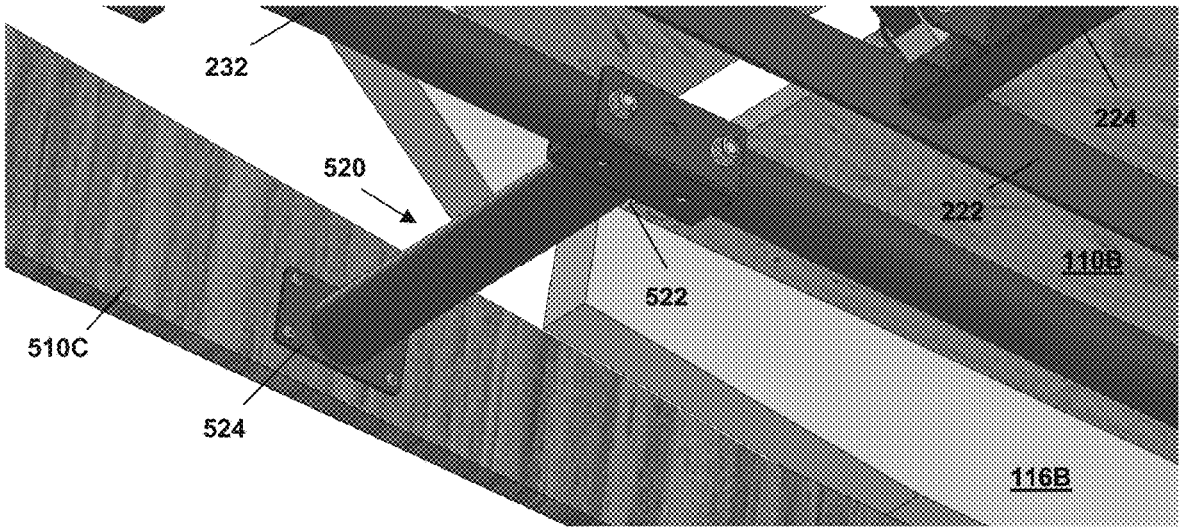
FIG. 17 is a bottom side perspective view of an adjustable bed according to the disclosure including a rail system according to the first embodiment.
Figure 18:
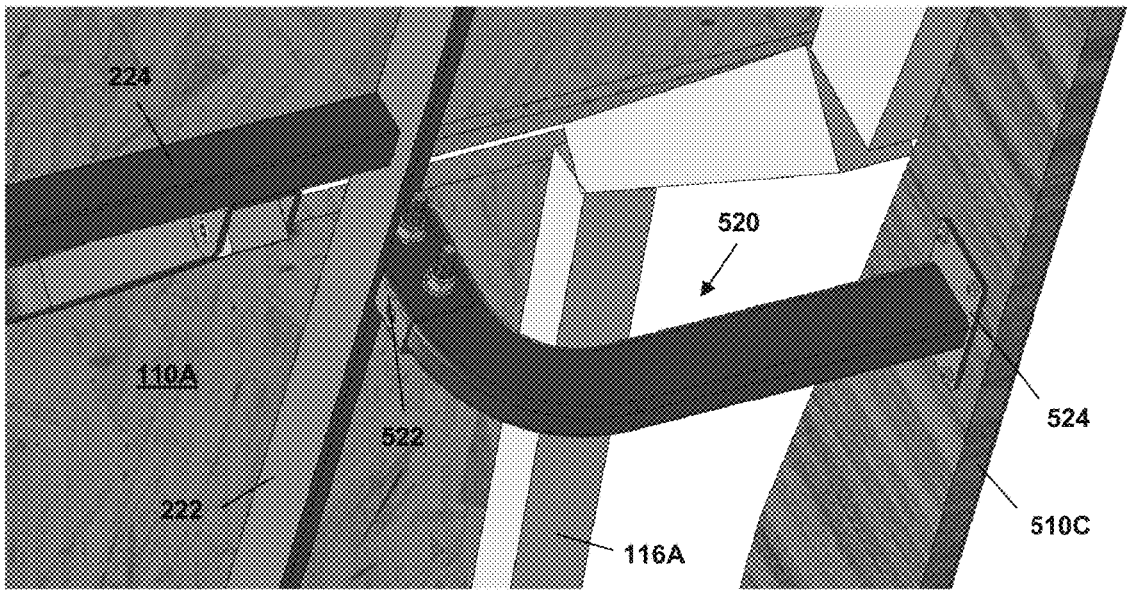
FIG. 18 is a bottom side perspective view of an adjustable bed according to the disclosure including a rail system according to the second embodiment.

As illustrated, the adjustable frame 200 further includes a subframe 230, for example a rigid, non-articulatable frame structure which sits on a floor or within a decorative bed frame common in the furniture industry such as a platform bed (e.g., via various leg elements, not shown) and provides stability for the bed foundation 20 as the adjustable frame 200 is articulated to various different positions. The subframe 230 can include one or more structural components, for example including longitudinal subframe members 232, lateral subframe members 234, and/or feet or legs 236 (FIGS. 3, 4, 12, and 13). The adjustable frame 200 can further include one or more support members 220 connecting structure between the subframe 230 and the frame support 210 and sections 210A-210D thereof. The support members 220 can include one or more vertical support members 226 as well as one or more longitudinal support members 222 and/or lateral support members 224 mounted to the vertical support members 226 to provide a base or support for the frame support 210 (FIGS. 3, 4, 12, and 16-18). The vertical support members 226 can be mounted to the subframe 230 or components thereof, and the longitudinal and/or lateral support members 222, 224 can be mounted to the vertical support members 226. In some embodiments, the adjustable frame 200 can further include rollers 228, for example mounted to the vertical support members 226, which rollers 228 engage the longitudinal subframe members 232 and permit longitudinal movement forward or backward of the support frame 220, frame support 210, and the mattress support 100 (FIGS. 3, 4, 12, and 14). In some embodiments the vertical support members 226 are fixedly mounted to the subframe 230 or component thereof (FIG. 16). In such embodiments, the support frame 220 is in a stationary or fixed longitudinal and lateral position relative to the subframe 230, although rotational movement or articulation of the frame support 210 and the mattress support 100 is possible. In some embodiments, one or more of the frame sections 210A-210D can be fixed in position relative to the subframe 230 (e.g., bottom section 210C as illustrated) and be unable to rotate or articulate relative to the subframe 230, although other frame sections pivotally attached thereto are able to rotate or articulate. As further illustrated, the adjustable frame 200 can include one or more actuators 240 variously mounted to one or more of the subframe 230, a support member 220, and a frame support section 210A-210D. In some embodiments, the subframe 230, the support members 220, and the frame support sections 210A-210D can be formed from metal such as steel. The actuators 240 can be any of those commonly known in the art. The actuators 240 and, correspondingly, the configuration or position of the adjustable frame 200, mattress support 100, and mattress 300 can be controlled and adjusted by a suitable power supply (not shown), adjustable bed controller 250 (e.g., programmable logic controller or otherwise), and remote control to deliver repositioning commands (not shown).

The mattress 300 is not particularly limited, and it can be a conventional mattress 300 (e.g., a spring or coil mattress, memory foam mattress, air mattress) with a base 310 (e.g., a continuous fabric material) suitable for use on a mattress support structure such as a fixed bed frame or an adjustable bed frame. The mattress suitably has a thickness of at least 20 cm (e.g., at least 20 cm, 30 cm, or 35 cm and/or up to 30 cm, 40 cm, or 50 cm). In the illustrated embodiment, the mattress 300 includes a mattress containment frame 305 including a plurality of foam cells (or foam springs) 340 positioned in the frame 305 to provide the sleeping support surface for the mattress. The mattress containment frame 305 includes a lower/bottom base 310, sidewalls 320, and endwalls 330 which generally define the interior frame 305 volume housing the foam cells 340. The sidewalls 320 and endwalls 330 suitably are formed from a foam material. The base 310 can be a generally continuous fabric material. The mattress 300 is generally positioned above the mattress support 100 surface 112, for example sitting directly atop the deck support sections 110A-110D. In other embodiments, other structure between the mattress 300 and mattress support 100 surface 112 can be present, for example a padding or cushion material.

FIGS. 3-6 illustrate an embodiment in which the lumbar and neck support system 400 includes an inflatable lumbar support 410 and an inflatable neck support 420. Suitably, the inflatable supports 410, 420 are formed from a durable fabric or plastic material. The inflatable lumbar support 410 is positioned in a bottom region B of the first deck support section 110D (e.g., bottom 20%, 30%, 40%, or 50% of longitudinal length L of the first deck support section 110D, measured relative to the end of the first deck support section 110D adjacent the second deck support section 110C), such that the lumbar support 410 exerts pressure when inflated against the lumbar region of a person laying or sitting on the adjustable bed 10. Similarly, the inflatable neck support 420 is positioned in a top region T of the first deck support section 110D (e.g., top 20%, 30%, 40%, or 50% of longitudinal length L of first deck support section 110D, measured relative to the end of the first deck support section 110D corresponding to the head end of the adjustable bed 10), such that the neck support 420 exerts pressure when inflated against the neck region of a person laying or sitting on the adjustable bed 10. The inflatable lumbar support 410 laterally extends across the first deck support section 110D and is disposed on an upper surface 112D of the first deck support section 110D. Suitably, the inflatable lumbar support 410 and/or the inflatable neck support 420 extends at least 60%, 70%, 80%, or 90% of the mattress support surface 100 lateral width W. In some embodiments, the inflatable lumbar support 410 and/or the inflatable neck support 420 is a single inflatable bladder extending across the first deck support section 110D (e.g., at least 60%, 70%, 80%, or 90% of the lateral width W of the mattress support surface 200 or the first deck support section 110D, such as for a twin, queen, or king size bed). In other embodiments, the inflatable lumbar support 410 and/or the inflatable neck support 420 includes a plurality of inflatable bladders 410A, 410B and/or 420A, 420B extending across the first deck support section 110D. For example, there can be two separate bladders on adjacent support halves corresponding to a bed section for a first person and a second person such as on a queen, split queen, king, or split king bed 10. The plurality of bladders can be in fluid communication so that they inflate/deflate together, or they can be fluidly isolated from each other so that they can be independently inflated and deflated. As specifically shown in FIG. 4, the bed 10 can further include a means 430 for supplying pressure to the inflatable lumbar support 410 and the inflatable neck support 420, for example including an air pump or compressor along with suitable valves and tubing (not shown) for independently inflating and deflating the various supports/bladders.

Figure 5:
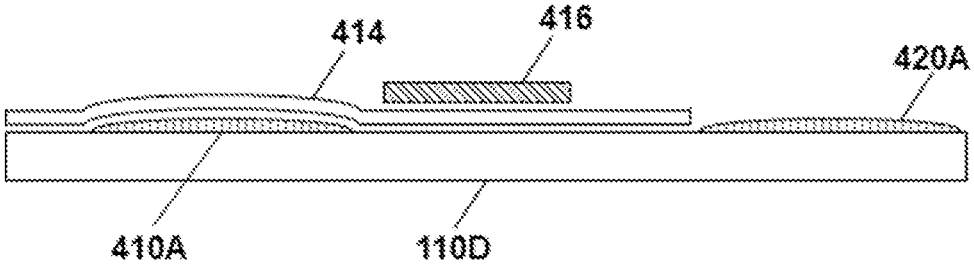
FIG. 5 is a side view of an adjustable bed according to the disclosure including inflatable air bladder lumbar and neck support structures and a pressure distribution member in a relaxed state.
Figure 6:
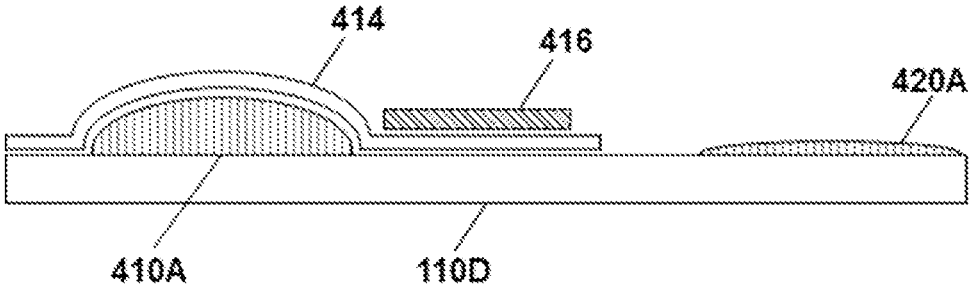
FIG. 6 is a side view of an adjustable bed according to the disclosure including inflatable air bladder lumbar and neck support structures and a pressure distribution member in an extended state.
Figure 7:
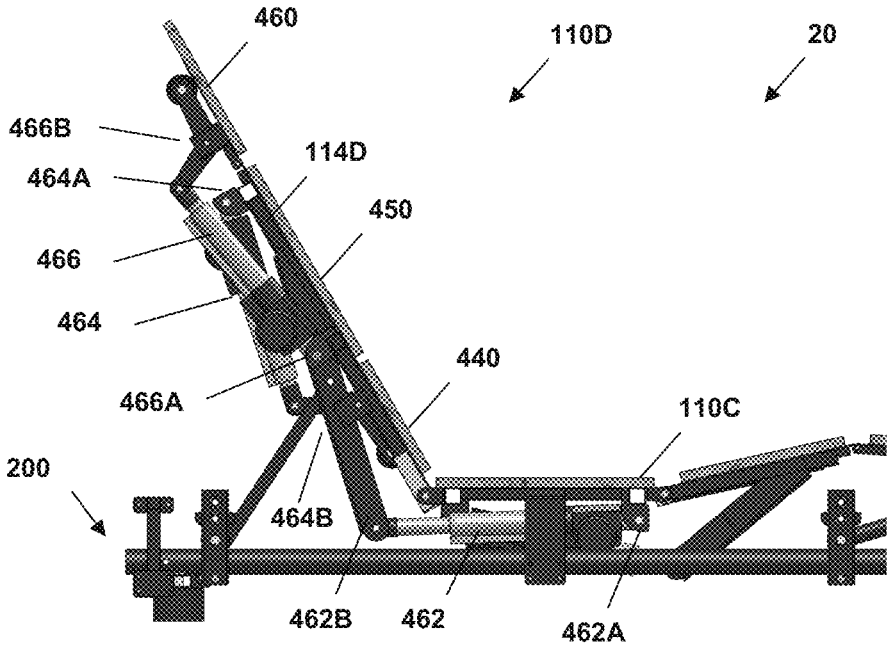
FIG. 7 is a side view of an adjustable bed according to the disclosure including mechanical lumbar and neck support structures in a flat state.
Figure 8:
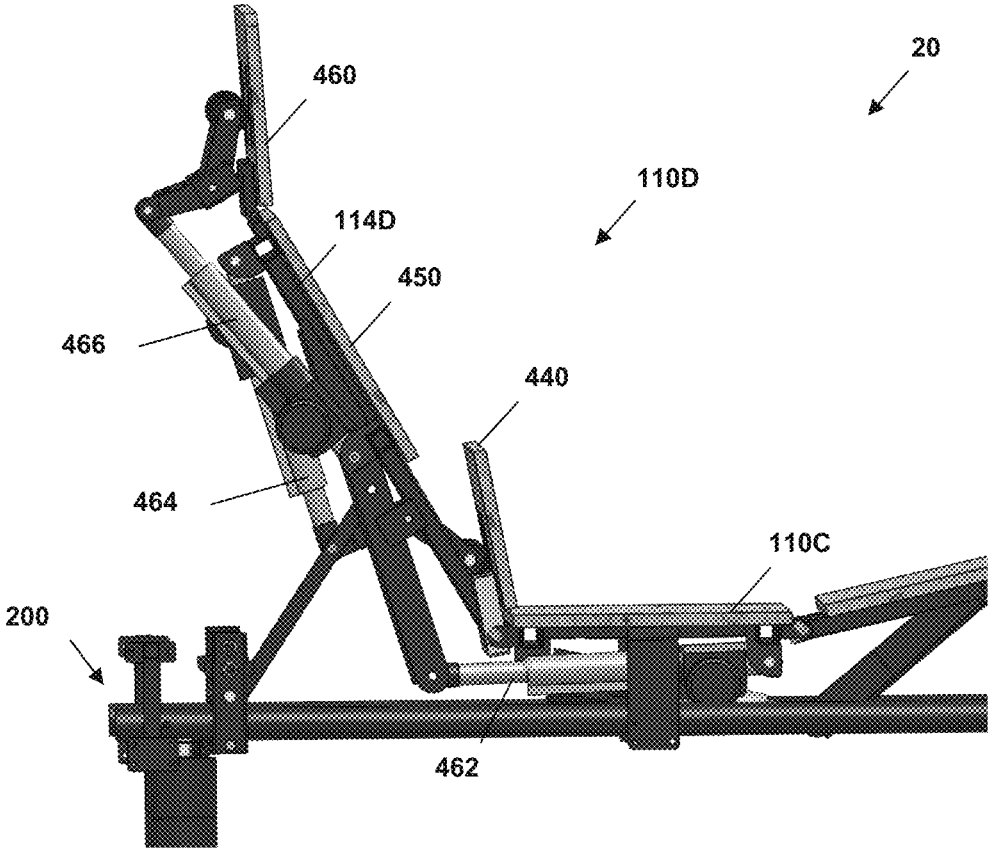
FIG. 8 is a side view of an adjustable bed according to the disclosure including mechanical lumbar and neck support structures in an articulated state.
Figure 9:
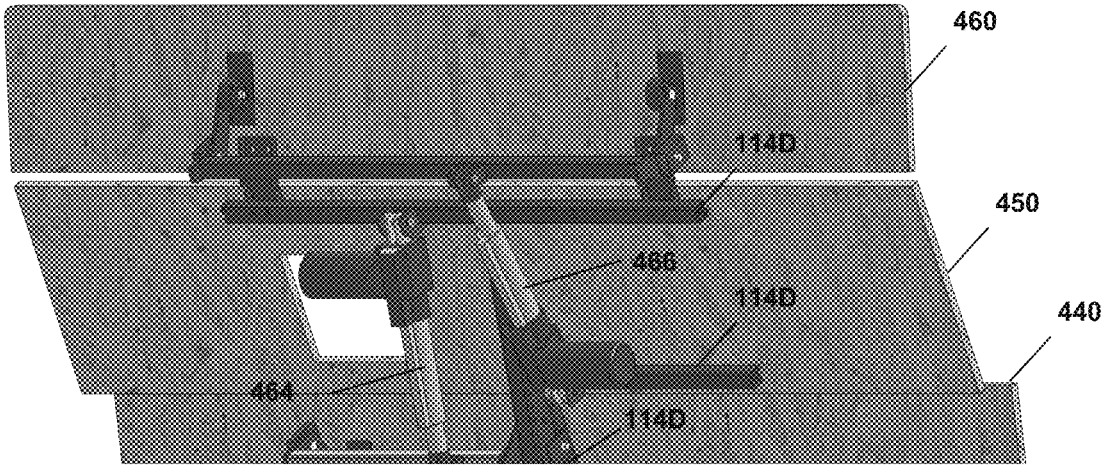
FIG. 9 is an upper rear perspective view of an adjustable bed according to the disclosure including mechanical lumbar and neck support structures in an articulated state.
Figure 10:
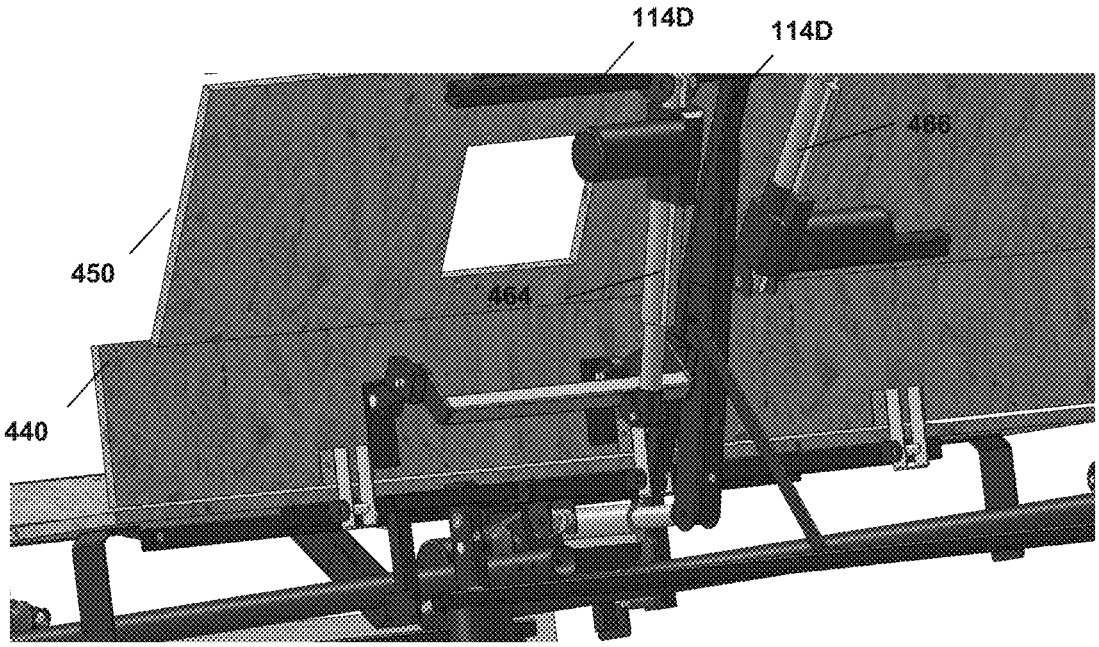
FIG. 10 is a lower rear perspective view of an adjustable bed according to the disclosure including mechanical lumbar and neck support structures in an articulated state.
Figure 11:
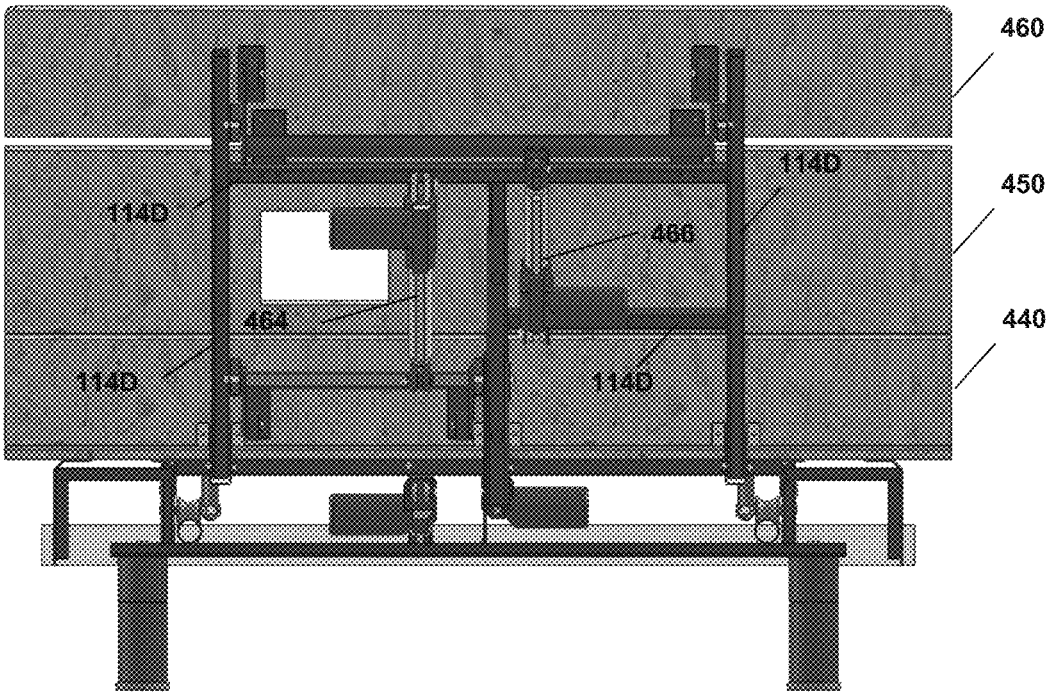
FIG. 11 is a rear view of an adjustable bed according to the disclosure including mechanical lumbar and neck support structures in a flat state.

In a particular embodiments shown in FIGS. 5 and 6, the bed 10 can further include a flexible lumbar pressure distribution member 414 mounted to the first deck support 110D section and at least partially covering or enclosing the inflatable lumbar support 410. Similarly, the bed can include an analogous flexible neck pressure distribution member (not shown) mounted to the first deck support section 110D and at least partially covering or enclosing the inflatable neck support 420. For example, the pressure distribution member can be a thin but rigid plastic material or sheet that can deform and conform to the curvature of the underlying bladder, but which provides lateral support to laterally distribute the pressure of a person's lumbar/back or head/neck to lessen bladder sag in the region where the person is located. One longitudinal end of the pressure distribution member can be fixedly mounted to the first deck support section 110D and the opposing longitudinal end can have a floating or sliding mount such as through a sleeve 416 fixedly mounted to the first deck support section 110D (e.g., where the illustrated sleeve 416 can further accommodate a complementary neck pressure distribution member when present).

FIGS. 7-11 illustrate an embodiment in which the lumbar and neck support system 400 is in the form of a multi-section first deck support section 110D. The first deck support section 110D includes a longitudinally extending support frame 114D (e.g., steel or other metal) pivotally attached to the second deck support section 110C, a lumbar support deck section 440, a back support deck section 450, and a head support deck section 460. The a back support deck section 450 is fixedly mounted to an upper surface of a middle section of the support frame 114D. The a lumbar support deck section 440 is pivotally mounted to the second deck support section 110C and is positioned above an upper surface of a bottom section of the support frame 114D (e.g., having an opposing free end adjacent the back support deck section 450). The head support deck section 460 is pivotally mounted to the support frame 114D and is positioned above an upper surface of a top section of the support frame 114D (e.g., having an opposing free end at the head end of the bed 10).

The lumbar and neck support system 400 further includes first, second, and third actuators 462, 464, and 466. The first actuator 462 has a first end 462A mounted to one or more of the second deck support section 110C (e.g., a supporting frame member thereof) and the stationary bed frame 200, and a second end 462B mounted to the support frame 114D. The first actuator 462 is adapted to move the support frame 114D between articulated and substantially flat positions relative to the stationary bed frame 200. Suitably, the first end 462A has a fixed pivotal attachment to the second deck support section 110C and/or the stationary bed frame 200, and the second end 462B has a fixed pivotal attachment to the support frame 114D. The second actuator 464 has a first end 464A mounted to the support frame 114D, and a second end 464B mounted to the lumbar support deck section 440. The second actuator 464 is adapted to move the lumbar support deck section 440 between articulated and substantially flat positions relative to the support frame 114D. Suitably, the first end 464A has a fixed pivotal attachment to the support frame 114D, and the second end 464B has a floating pivotal attachment to the lumbar support deck section 440 (e.g., floating wheels or rollers contacting the lumbar support deck section 440). The third actuator 466 has a first end 466A mounted to the support frame 114D, and a second end 466B mounted to the neck support deck section 460. The third actuator 466 is adapted to move the neck support deck section 466 between articulated and substantially flat positions relative to the support frame 114D. Suitably, the first end 466A has a fixed pivotal attachment to the support frame 114D, and the second end 466B has a floating pivotal attachment to the neck support deck section 460 (e.g., floating wheels or rollers contacting the neck support deck section 460).

FIGS. 12-18 illustrate an adjustable bed 10 according to another aspect of the disclosure in which the bed 10 includes a rail system 500. Although the embodiments in FIGS. 12-18 are generally illustrated as including the lumbar support 440 of the lumbar and neck support system 400 as described above, it is understood that embodiments of the adjustable bed 10 including rail system 500 can include some, all, or none of the various features of the lumbar and neck support system 400.

The adjustable bed 10 includes a stationary bed frame 200 that includes a stationary subframe 230 and that can further include one or more support members 220 mounted to the subframe 230 for supporting a mattress support surface 100, one or more deck support sections 110, and/or one or more frame support sections 210. The bed frame is stationary in the sense that the subframe 230 and/or components thereof are stationary (e.g., in a fixed position relative to the ground or other underlying support surface for the bed 10), although the support members 220, the frame support sections 210, the deck support sections 110, and/or the mattress support surface 100 can be moveable components of the bed 10 relative to the subframe 230 (e.g., longitudinal motion of the support members 220, rotational motion or articulation of the frame support sections 210, the deck support sections 110, and/or the mattress support surface 100). The mattress support surface 100 is supported by the stationary bed frame 200, for example being mounted directly or indirectly to the subframe 230 and/or the one or more support members 220 (when present). The mattress support surface 100 generally includes a first deck support section 110, and a second deck support section 110 pivotally attached to the first deck support section 110. In the illustrated embodiments, the mattress support surface 100 includes four pivotally connected deck support sections 110A, 110B, 110C, 110D corresponding to the foot, leg, bottom, and back/head portions of the deck support 110, respectively. Similarly, the bed can include an adjustable frame support 210 as a mounting structure between the mattress support surface 100 and the bed frame 200 (e.g., to the support members 220 and/or the subframe 230), for example including frame support sections 210A-210D corresponding to the deck support sections 110A-110D.

The rail system 500 generally includes one or more mounting elements 520 fixedly or detachably mounted to the bed frame 200 and one or more rails 510 fixedly or detachably mounted to the mounting elements 520. As more particularly shown in FIGS. 14-18, a given mounting element 520 generally includes a first end 522 mounted (e.g., fixedly or detachably) to the subframe 230 or the support member 220 (when present) and a second end 524. The second end 524 extends outwardly from the stationary bed frame 200 and is positioned at a location at or below the subframe 230 (e.g., below a plane defined by the subframe 230 or elements thereof) relative to the mattress support surface 100 (e.g., where the location of the mattress support surface 100 defines the relative location above the subframe 230). Further, a given rail 510 is (fixedly or detachably) mounted to the second end 524 of a corresponding mounting element 520. In an embodiment, the first end 522 of the mounting element 520 is detachably mounted to the subframe 230 or the support member 220 (when present). Alternatively or additionally, the second end 524 of the mounting element 520 can be detachably mounted to the rail 510. The rail 510 generally extends along an external side of the subframe 230 (e.g., along the entire side length thereof), for example along an external side generally parallel with a longitudinal subframe element 232 corresponding to a left or right side of the adjustable bed 10/bed frame 200, or along an external side generally parallel with a lateral subframe element 234 corresponding to a head or foot end of the adjustable bed 10/bed frame 200.

Various embodiments for the rails 510 are possible. As generally shown in FIGS. 12-17, a particular rail 510 can vertically extend below the subframe 230 (e.g., below a plane defined by the subframe 230 or elements thereof, such as toward the floor). Similarly, a particular rail 510 alternatively or additionally can vertically extend above the subframe 230 (e.g., above a plane defined by the subframe 230 or elements thereof, such as toward the mattress support surface). The rail 510 can be configured (e.g., sized/shaped) such that vertical extension of the rail 510 above and/or below the subframe 230 conceals from external view (i.e., relative to the bed 10) one or more metal or other structural components below the mattress support surface 100, such as one or more of the subframe 230, support members 220, frame supports 210, deck supports 110, actuators 240, and/or control boxes (not shown). The rail 510 can be made from or otherwise include any desired material, suitable examples of which include one or more of wood and metal (e.g., steel). The rail system 500 can include a plurality of rails 510 which collectively form a rail border 512 around the perimeter around the adjustable bed 10/bed frame 200. For example, as illustrated, the rail border 512 can include rails or boards 510A, 510B, 510C, 510D corresponding to the foot, (right) side, (left) side, and head portions of the rail border 512, respectively. In a particular embodiment, the rail system 500 includes at least 4 rails 510 (e.g., rails 510A-510D) and at least 4 corresponding mounting elements 520, such that there is at least one corresponding mounting element 520 for each rail 510 and the rails 510 collectively form the continuous rail border 512 around the external perimeter of the adjustable bed 10 (e.g., foot, head, and side rails 510, and one or more corresponding mounting elements 520 for each rail 510).

In some embodiments, and as shown in FIGS. 12, 12A, 12B, and 13, the mattress support surface 100 further includes at least a first deck support spacer 116, which extends along an external side 118 of the first deck support section 110 and vertically extends below the first deck support section 110 (e.g., toward the subframe 230), and a second deck support spacer 116, which extends along an external side or edge 118 of the second deck support section 110 and vertically extends below the second deck support section 110 (e.g., toward the subframe 230). For example, as particularly illustrated, the mattress support surface 100 can include deck support spacers 116A, 116B, 116C, 116D along external sides 118A, 118B, 118C, 118D corresponding to the foot, leg, bottom, and back/head deck support sections 110A, 110B, 110C, 110D, respectively. The foot and head deck support sections 110A, 110D can further include deck support spacers 116 along their external end or edge 118. In an embodiment, when the mattress support surface 110 is in a flat configuration, the deck support spacers 116 and the rail 510 can form a substantially continuous side surface 530 to the adjustable bed 10 (e.g., to the stationary bed frame 200), such as along a lateral or longitudinal edge of the bed 10/bed frame 200. In a refinement, the deck support spacers 116 and the rail 510 can have complementary shapes such that they are in contact to form the continuous side surface 530. In another refinement, the deck support spacers 116 and the rail 510 can have complementary shapes such that they are in close proximity to form the continuous side surface 530 having a small gap 532 (e.g., at least 1 mm, 2 mm, 5 mm, 10 mm, or 25 mm and/or up to 5 mm, 10 mm, 15 mm, 25 mm, or 50 mm) between adjacent elements (e.g., two adjacent spacers 116, an adjacent spacer 116 and rail 510). In another embodiment, the deck support spacers 116 along all head, foot, and side edges of all deck support sections 110 in the adjustable bed 10 collectively form with the rails 510 (e.g., rails 510A-510D) four substantially continuous side surfaces 530 around the entire perimeter of the bed 10/bed frame 200. In an embodiment, the deck support spacers 116 are formed from or otherwise include as a component a polymeric foam (e.g., partially or entirely formed therefrom; such as a natural or artificial latex foam, polyurethane foam, etc.). The deck support spacers 116 and the rails 510 can be formed from the same or different materials. For example, all can be formed from wood, all from metal, all from a polymeric foam, etc. Alternatively, all from one group of either the support spacers 116 or rails 510 can be formed from wood, metal, or a polymeric foam, and all from the other group can be formed from a different material such as wood, metal, or a polymeric foam.

Various embodiments for the mounting elements are possible, in particular as illustrated in FIGS. 14-18. In some embodiments, the mounting element 520 can be mounted to the subframe 230. For example, the mounting element 520 can be mounted to a longitudinal subframe member 232 extending between head and foot ends of the adjustable bed 10 (e.g., stationary bed frame 200 thereof), such as shown in FIGS. 12 and 14-16 (connecting the head rail 510A to the longitudinal subframe member 232) and FIG. 17 (connecting the side rail 510C to the longitudinal subframe member 232). For example, the second end 524 of the mounting element 520 can extend outwardly from the stationary bed frame 200 substantially parallel to the subframe 230 (e.g., substantially in the plane defined by the subframe 230 or components thereof). In a particular embodiment, and as described above, the mattress support surface 100 can be longitudinally slidably mounted to the longitudinal subframe member 232 (e.g., to two longitudinal subframe member 232 on opposing sides of the adjustable bed 10/stationary bed frame 200, thus permitting forward/backward movement of the mattress support surface 100 relative to the subframe 230, such as to move toward or away from an adjacent wall surface during articulation). The slidable mounting can include rollers 228 mounted to the mattress support surface 100, deck support 110 thereof, or support member 220 mounted thereto, which rollers 228 can roll on the longitudinal subframe members 232. In some embodiments, the stationary bed frame 200 includes the support member 200, and the mounting element 520 is mounted thereto. For example, the subframe 230 can omit the longitudinal subframe members 232 extending between head and foot ends of the adjustable bed 10/bed frame 200, and the subframe 230 can include a lateral subframe member 234 to provide subframe 230 support, such as shown in FIGS. 13 and 16. In a refinement, the support member 220 can be in a fixed position relative to the subframe 220. In another refinement, the first end 522 of the mounting element 520 can extend downwardly from the support member 220 and the second end 524 of the mounting element 520 extends outwardly from the stationary bed frame 200 substantially parallel to the subframe 230 (e.g., substantially in or below the plane defined by the subframe 230), for example as illustrated by the generally L-shaped mounting element or elbow 520 in FIGS. 13 and 18. In various embodiments, the mounting element 520 can include a receiving sleeve 528, for example a U-, C-, or O-shaped sleeve 528 which is shaped or adapted to receive and mount a separate component of the mounting element 520 or a component of the subframe 230 or support member 220 to which the mounting element 520 is attached. As further illustrated, the mounting element 520 can include a slot 526 (e.g., along the length of a sidewall such as in the receiving sleeve 528) which permits variable-length attachment (e.g., in the lateral or longitudinal direction) between subframe 230 and the rail 510 (e.g., to facilitate detachable mounting therebetween and/or to accommodate variably sized rails 510 forming a rail border 512 with larger or smaller dimensions).

Rawls-Meehan U.S. Pat. Nos. 7,321,811, 7,465,280, 7,805,785, 7,930,783, 7,933,669, 7,979,169, 8,019,486, 8,032,263, 8,032,960, 8,046,114, 8,046,115, 8,046,116, 8,046,117, 8,050,805, 8,069,512, 8,078,336, 8,078,337, 8,150,562, 8,375,488, 8,565,934, and 8,682,457 as well as Rawls-Meehan U.S. Publication No. 2012/0057685 and 2014/0325761 are incorporated herein by reference in their entireties and variously disclose mattresses including foam springs or foam cells and materials/configurations therefor, adjustable bed assemblies including adjustable mattress frames, electrical, mechanical, and electronic components associated therewith, and remote controls for use therewith, all of which may be used individually or collectively in combination with the adjustable bed described herein.

Because other modifications and changes varied to fit particular operating requirements and environments will be apparent to those skilled in the art, the disclosure is not considered limited to the example chosen for purposes of illustration, and covers all changes and modifications which do not constitute departures from the true spirit and scope of this disclosure.

Accordingly, the foregoing description is given for clearness of understanding only, and no unnecessary limitations should be understood therefrom, as modifications within the scope of the disclosure may be apparent to those having ordinary skill in the art.

All patents, patent applications, government publications, government regulations, and literature references cited in this specification are hereby incorporated herein by reference in their entirety. In case of conflict, the present description, including definitions, will control.

Throughout the specification, where the apparatus, methods, or processes are described as including components, steps, or materials, it is contemplated that the apparatus, methods, or processes can also comprise, consist essentially of, or consist of, any combination of the recited components or materials, unless described otherwise.

PARTS LIST

10 adjustable bed (including mattress support 100, adjustable frame 200, mattress 300, optionally lumbar and neck support system 400, and optionally rail system 500)

20 adjustable foundation (including mattress support 100, adjustable frame 200, optionally lumbar and neck support system 400, and optionally rail system 500)

100 mattress support (or deck) surface

110 deck support (sections 110A-D as foot, leg, bottom, and back/head portions; longitudinally opposed ends 110$A_1$ and 110$A_2$, 110$B_1$ and 110$B_2$, 1100$_1$ and 1100$_2$, 110$D_1$ and 110$D_2$)

112 top surface of deck support (sections 112A-D as for deck support)

114 support frame

116 deck support spacer

118 side or edge of deck support

200 adjustable (bed) frame

210 frame support (sections 210A-D as for deck support)

220 support member

222, 224, 226 longitudinal, lateral, and vertical support member

228 roller

230 subframe

232, 234 longitudinal and lateral subframe member

236 feet/legs

240 actuator or movement/articulation means

250 adjustable bed controller

300 mattress (300A: foot end; 300D: head end)

305 containment frame

310 base

320 sidewalls

330 endwalls

340 foam cells or foam springs

400 lumbar and neck support system

410 lumbar support structure

414 flexible lumbar pressure distribution member

416 sleeve

420 neck support structure

430 means for supplying pressure

440 lumbar support deck section

450 back support deck section

460 neck support deck section

462, 464, 466 first, second, and third actuators

500 rail system

510 rail or board (foot rail or board 510A, side rails or boards 510B/5100, head rail or board 510D)

512 rail border (e.g., collective boards around perimeter)

520 mounting element (e.g., bracket and rod/body)

522 mounting element first end

524 mounting element second end

526 slot permitting variable-length attachment (lateral or longitudinal direction)

528 receiving sleeve (e.g., U-, C-, or O-shaped sleeve)

530 continuous side surface

532 gap between side surface elements

X (local) lateral direction

Y (local) longitudinal direction
Z (local) normal direction
P pivot axis
Θ angle of articulation between adjacent sections

What is claimed is:

1. An adjustable bed comprising:

(a) a stationary bed frame comprising (i) a stationary subframe comprising a lateral subframe member extending between sides of the adjustable bed, and (ii) a longitudinal support member mounted to the subframe for supporting a mattress support surface;

(b) a mattress support surface supported by the stationary bed frame and comprising (i) a first deck support section, and (ii) a second deck support section pivotally attached to the first deck support section;

(c) a first mounting element having (i) a first end mounted to the longitudinal support member and (ii) a second end extending outwardly from the stationary bed frame and positioned at a location at or below the subframe, wherein the first end of the first mounting element extends downwardly from the longitudinal support member and the second end of the first mounting element extends outwardly from the stationary bed frame;

(d) a first longitudinal rail mounted to the second end of the first mounting element, the first longitudinal rail extending along an external longitudinal side of the subframe;

(e) a second mounting element having (i) a first end mounted to the lateral subframe member and (ii) a second end extending outwardly from the lateral subframe member; and (f) a second lateral rail mounted to the second end of the second mounting element, the second lateral rail extending along an external lateral side of the subframe;

wherein the subframe does not include a longitudinal subframe member extending between head and foot ends of the adjustable bed.

2. The adjustable bed of claim 1, wherein the first and second rails vertically extend below the subframe.

3. The adjustable bed of claim 1, wherein the first and second rails vertically extend above the subframe.

4. The adjustable bed of claim 3, wherein the mattress support surface further comprises (i) a first deck support spacer extending along an external side of the first deck support section and vertically extending below the first deck support section, and (ii) a second deck support spacer extending along an external side of the second deck support section and vertically extending below the second deck support section.

5. The adjustable bed of claim 4, wherein, when the mattress support surface is in a flat configuration, the first deck support spacer, the second deck support spacer, and the rail form a substantially continuous side surface to the adjustable bed.

6. The adjustable bed of claim 4, wherein the first deck support spacer, the second deck support spacer, and the first and second rails are formed from the same or different materials.

7. The adjustable bed of claim 4, wherein the first deck support spacer and the second deck support spacer are formed from a polymeric foam.

8. The adjustable bed of claim 7, wherein the first and second rails are formed from a material selected from the group consisting of wood, metal, and combinations thereof.

9. The adjustable bed of claim 1, wherein:

the first end of the first mounting element is detachably mounted to the the longitudinal support member; and the first end of the second mounting element is detachably mounted to the lateral subframe member.

10. The adjustable bed of claim 1, wherein:

the second end of the first mounting element is detachably mounted to the first longitudinal rail; and the second end of the second mounting element is detachably mounted to the second lateral rail.

11. The adjustable bed of claim 1, wherein the first and second mounting elements each comprise a receiving sleeve.

12. The adjustable bed of claim 1, comprising at least 4 rails and at least 4 corresponding mounting elements, wherein:

there is at least one corresponding mounting element for each rail; and the at least 4 rails collectively form a continuous rail border around the external perimeter of the adjustable bed.

13. The adjustable bed of claim 1, wherein the first and second rails are formed from wood.

14. The adjustable bed of claim 1, wherein the first and second rails are formed from metal.

15. The adjustable bed of claim 1, wherein the mattress support surface further comprises (iii) a third deck support section pivotally attached to the second deck support section.

16. The adjustable bed of claim 1, further comprising a mattress positioned above the mattress support surface.

17. The adjustable bed of claim 16, wherein the mattress is selected from the group consisting of a spring mattress, a coil mattress, a memory foam mattress, and an air mattress.

18. An adjustable bed kit comprising:

(a) a stationary bed frame comprising (i) a stationary subframe comprising a lateral subframe member extending between sides of the adjustable bed, and (ii) a longitudinal support member mounted to the subframe for supporting a mattress support surface;

(b) a mattress support surface supported by the stationary bed frame and comprising (i) a first deck support section, and (ii) a second deck support section pivotally attached to the first deck support section;

(c) a first mounting element having (i) a first end adapted to be mounted to the longitudinal support member and (ii) a second end extending outwardly from the stationary bed frame and positioned at a location at or below the subframe when the first mounting element is mounted to the longitudinal support member, wherein the first end of the first mounting element extends downwardly from the longitudinal support member and the second end of the first mounting element extends outwardly from the stationary bed frame;

(d) a first longitudinal rail adapted to be mounted to the second end of the first mounting element, wherein, when mounted to the first mounting element, the first longitudinal rail extends along an external longitudinal side of the subframe;

(e) a second mounting element having (i) a first end adapted to be mounted to the lateral subframe member and (ii) a second end extending outwardly from the lateral subframe member when the second mounting element is mounted to the lateral subframe member; and (f) a second lateral rail adapted to be mounted to the second end of the second mounting element, wherein, when mounted to the second mounting element, the second lateral rail extends along an external lateral side of the subframe;

wherein the subframe does not include a longitudinal subframe member extending between head and foot ends of an adjustable bed corresponding to the adjustable bed kit.

* * * * *